United States Patent [19]

Lamm

[11] 3,972,794

[45] Aug. 3, 1976

[54] ELECTROLYTIC CELL

[76] Inventor: August Uno Lamm, 365 Moseley Road, Hillsborough, Calif. 94010

[22] Filed: Sept. 20, 1974

[21] Appl. No.: 507,980

[30] Foreign Application Priority Data

Sept. 26, 1973 Australia ..... 60759/73

[52] U.S. Cl. ..... 204/266; 204/149; 204/258; 204/260

[51] Int. Cl.[2] ..... C25B 1/26; C25B 9/00

[58] Field of Search ..... 204/149, 258, 260, 266

[56] References Cited

UNITED STATES PATENTS

| | | | |
|---|---|---|---|
| 972,947 | 10/1910 | Townsend | 204/266 X |
| 1,336,281 | 4/1920 | Cataldi | 204/258 X |
| 3,223,242 | 12/1965 | Murray | 204/266 X |
| 3,297,561 | 1/1967 | Harrison et al. | 204/250 X |

*Primary Examiner*—John H. Mack
*Assistant Examiner*—A. C. Prescott

[57] ABSTRACT

An electrolytic cell for generating chlorine by decomposing brine has a housing defining therein closed anode and cathode chambers disposed side by side and communicating with each other through a vertical semi-permeable diaphragm. The anode and the cathode are spaced both horizontally and vertically with the anode either at the higher or the lower level and also at a higher or a lower level than the diaphragm.

13 Claims, 8 Drawing Figures

ELECTROLYTIC CELL

The present invention concerns improvements in small electrolytic cells for decomposing of brine (sodium chloride dissolved in water) into chlorine gas and other products. A particular purpose of this cell is to create and maintain a suitable chlorine content in swimming pools, but the improved cell can also be useful in other applications where a small an sometimes intermittent supply of chlorine is required.

The operating conditions for chlorine electrolytic cells for such purpose is quite different from those of chlorine-alkali cells in industrial use. Not only is the rating much smaller, some three to twenty amperes versus thousands of amperes, but also, economical considerations exclude much of the auxiliary equipment used in industrial plants, such as for purifying, recirculating and heating of the brine. Also, a cell useful for producing chlorine for swimming pools must be efficient even though it is frequently stopped and restarted. It should allow automatic operation of the complete chlorinator equipment with a minimum of maintenance and overhaul.

One major problem in chlorine cells is to keep the alkaline catholyte away from the vicinity of the anode in order to prevent the chlorine produced at the anode combining with the alkali to form liquid hypochlorite, instead of bubbling off in gaseous form as intended. One well-known method of reducing this phenomenon is the separation of the anode chamber from the cathode chamber by a porous wall known as a semi-permeable diaphragm, which allows the electricity-carrying ions to pass through but slows down the passage of liquid.

This method is very efficient where a considerable and continuous flow of liquid is maintained from the anode chamber through the diaphragm, thus holding off backflow of catholyte into the anode chamber. A cell for purpose mentioned above however should be able to work with a very small rate of flow of liquid through the cell, represented only by the amount of fresh brine required to supply the required chlorine output. This amount is normally only one or a few cubic centimeters per minute. And during the idle periods it should be possible to stop the flow of brine entirely in order not to waste salt. A considerable diffusion of liquid between the chambers through the diaphragm may therefore occur both during operation and particularly during stoppage.

Another common measure which tends to prevent formation of hypochlorite is to supply saturated brine to the anode chamber, sometimes by keeping an inventory of solid salt in the chamber itself. However, when saturated brine is used it has to be highly purified to avoid clogging of the diaphragm during extended operation and as indicated above, the use of highly purified brine would not be economically feasible in this case. Thus, for small cells it is desirable to avoid the use of saturated brine and to have unsaturated brine which has a much lesser tendency to clog the diaphragm by solid fallout even when ordinary commercial salt (rock salt) is used, dissolved in water of ordinary quality. On the other hand, the presence of unsaturated brine near the anode rather than saturated brine, aggravates the problems of hypochlorite formation.

The frequent stops and restarts of the cell also present problems at the cathode. During operation, the cathode surface is being deoxidized and, when operation ceases, the cathode is left bare of protecting oxide cover. The cathode material is therefore exposed to corrosion during stillstand, a phenomenon which does not occur in industrial chlorine cells which normally run continuously.

Conventional diaphragm cells are of two types, one having the cathode immersed in the electrolyte, the other one having non-immersed cathode. The first type generally has anodes and cathodes extended in vertical direction, their anode and cathode chambers being located side by side and separated by a likewise vertical diaphragm. The second type of cell mostly has a horizontal grid-type cathode located under the anode or anode assembly, and the diaphragm located immediately above and supported on the cathode. Under the non-immersed cathode is an empty space into which the alkali drops as it is formed by cathode action. This immediate removal of the alkali prevents its penetration into the anode chamber.

In the early days of the chlorine-alkali industry, a type of electrolytic cell called bell-jar or gravity cell, was used. It had no diaphragm but the anode was located inside an inverted bell jar, made of insulating non-porous material, while outside the bell jar, there was a ring-shaped cathode. Brine was fed at high rate to the vicinity of the anode, and the alkali liquid escaped from the ring-shaped space outside the bell. Owing to the slightly higher density of the alkali in relation to that of the brine, diffusion of alkali up towards the anode was arrested to some extent, it being also countered by the downward movement of the fresh brine being fed in. This type of cell is unsuitable for cells of low output because, owing to the slow movement of electrolyte, the separation of alkali from the brine in the vicinity of the anode would be insufficient.

In accordance with the present invention there is provided an electrolytic chlorine cell for the kind of operation described, with vertically extended diaphragm, which combines features of the diaphragm and the bell jar types of cell. More particularly, there is provided an electrolytic cell for oxidizing chloride ions to generate chlorine gas, comprising a housing having an anode chamber and a cathode chamber disposed side by side and in communication with each other through a vertical or substantially vertical semi-permeable diaphragm, an anode and a cathode disposed respectively in the anode and the cathode chamber, a brine inlet and a chlorine gas outlet in communication with the anode chamber, and an outlet in communication with the cathode chamber for discharging cathodic electrolysis products, characterized in that the anode is vertically spaced from the diaphragm and horizontally spaced from the cathode. The vertical spacing of the anode and the diaphragm in the cell according to the invention has been found to minimize the amount of the catholyte that can reach the space round the anode. At the same time, by having the diaphragm vertical or nearly vertical, the hydrogen formed at the cathode will be able to bubble up through the cathode chamber with little interference with the diaphragm. The lateral spacing between the anode and the diaphragm and between the diaphragm and the cathode can still be relatively small, limiting the length of the path for the electrical current.

Several embodiments of the invention will now be described in connection with description of the drawings, in which.

In all Figures, 1 denotes the anode, 2 the cathode and 3 the diaphragm, separating the closed anode and cathode chambers, which are denoted respectively 24 and 25. The exterior and interior walls of the cell may be made by rigid polyvinylchloride (PVC) or other material resistant to the chemicals present. The anode may be in the form of a sheet or grid or a rod of known anode material such as graphite, magnetite or titanium sheet coated with a noble metal such as platinum. The cathode could be made of uncoated titanium sheet. The diaphragm may be made of any known electrically nonconducting material for this purpose, including suitable porous plastic sheet.

In the examples shown in FIGS. 1 to 6, anode 1 and diaphragm 3 are combined into a separate subassembly joined to the other part of the cell by separable seals. This subassembly constitutes a cartridge which can be replaced by a new one when the anode and/or the diaphragm have spent their useful life.

Figure 1:
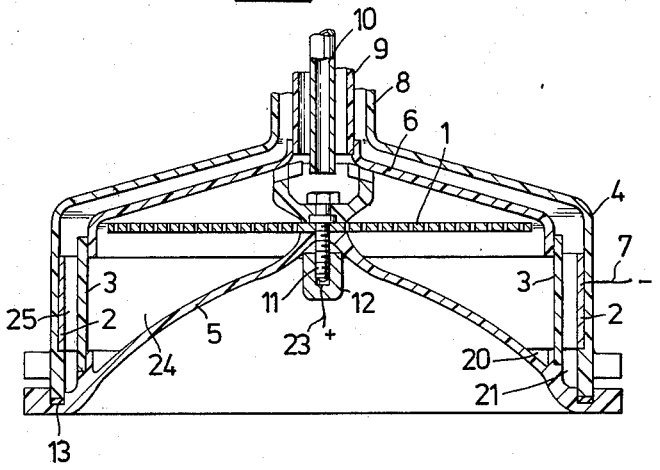
FIGS. 1 to 4 show, in vertical cross-sectional views, some alternative forms of cells according to the invention, all having a round cell vessel and essentially concentric anode and cahode chambers.
Figure 2:
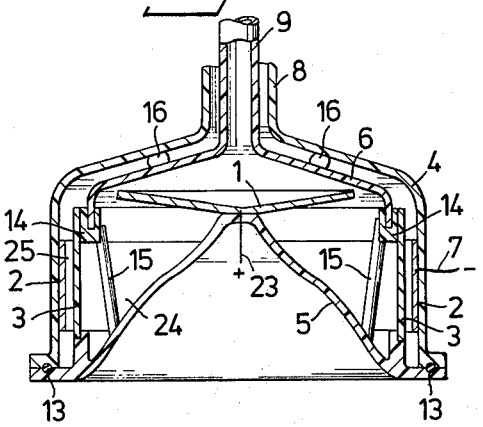
Figure 3:
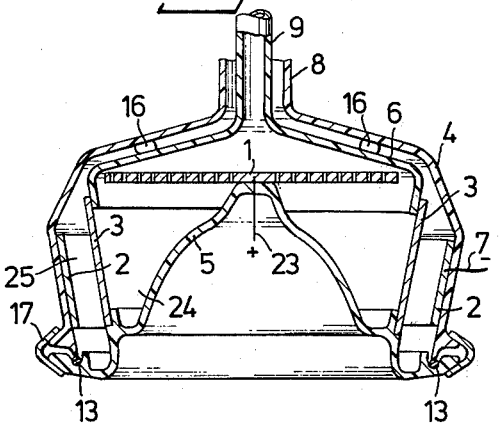

In FIGS. 1 to 3 the cell vessel consists of a cup-shaped outer housing part 4 and a cone-shaped bottom 5, joined to each other by a separable seal 13. The cathode 2 takes the form of a cylindrical or conical strip and is supported inside the housing part 4 and its electrical connection 7 is lead through the wall of the housing part 4. The bottom 5 supports the anode 1, the diaphragm 3 and a ceiling 6 which completes the separation of the annular anode and cathode chambers 24 and 25. The ceiling 6 as well as the top of housing part 4 are conical and converge into concentric tubes 8 and 9 allowing gas bubbles from the anode and cathode chambers to rise smoothly all the way to and up through these tubes. Hydrogen gas evolving at the cathode, together with escaping alkali liquid, rise in the cathode chamber 24 and through the interspace between tubes 8 and 9.

In FIG. 1 a special tube 10 is provided for separate entrance of fresh brine to the anode chamber 25 of the cell, while the chlorine gas rises from the anode chamber 25 and through the interspace between tubes 9 and 10.

Figure 4:
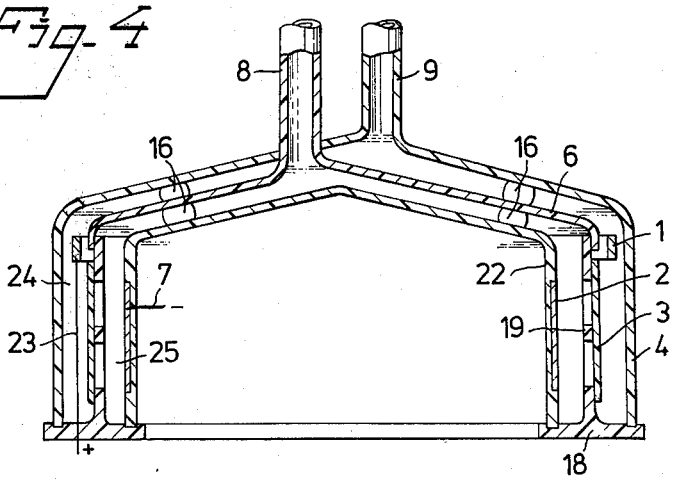

In FIGS. 2 to 4 the tube 9 serves both as exit for the chlorine and entry for the brine. A liquid trap (not shown in the drawing) may be arranged at the top end of tube 9 to separate the feed-in of brine from the conveying of the chlorine gas to the point where, under varying counter pressure, the chlorine gas is fed into the water system to be chlorinated.

Figure 5:
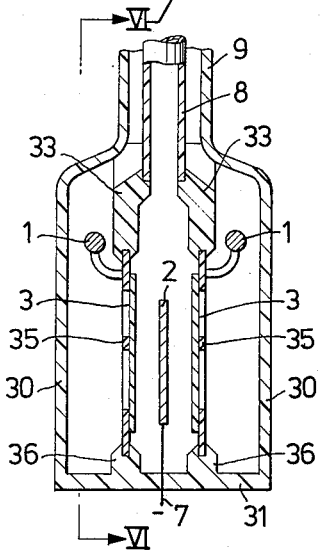
FIGS. 5 and 6 show an alternative design, having the anode and cathode chambers side by side in a straight orientation, FIG. 5 being a vertical cross-sectional view on line V—V of FIG. 6 and FIG. 6 being a vertical cross-sectional view on line VI—VI of FIG. 5.
Figure 6:
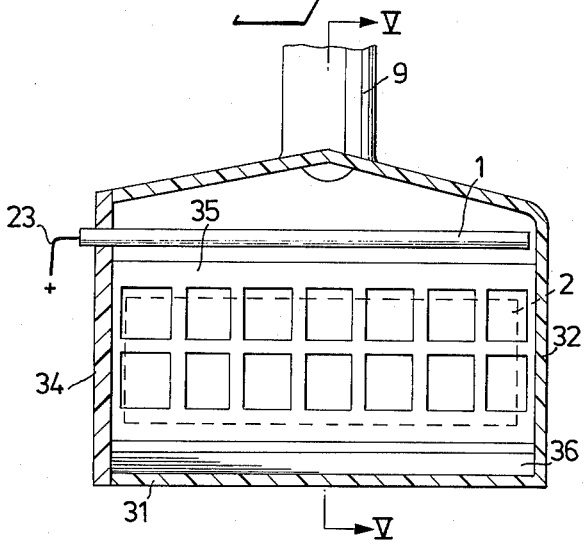

Characteristic to the cells shown in FIGS. 1 to 4, as well as to the cell shown in FIGS. 5 and 6, is that the upper portion of the diaphragm 3 extends upwards only to a level which is lower than the lowermost portion of the anode 1.

More specifically, FIG. 1 shows an anode 1 consisting of a horizontally disposed plane grid disc, allowing the chlorine to bubble through it. The ceiling 6, anode 1, diaphragm 3 and bottom 5 form the cartridge subassembly, held together by a bolt 11 which conveniently serves as electrical connection 23 for the anode and is fixed and sealed by a nut 12. The cartridge is joined to the housing cup by the seal 13 and a suitable clamping arrangement (not shown in the drawing). At the top, the mouth of ceiling 6 slips onto the lower end of tube 9, forming a fitting seal there. At the bottom of the anode and cathode chambers, space 20 and 21 are provided where sediment and other solid impurities can collect.

FIG. 2 is distinguished from FIG. 1 in that the anode 1 consists of an unperforated flat cone or dish the concave side of which is directed downwardly and allows the chlorine gas to seep along the dish surface and escape through an annular passage defined by the edge of the dish and the ceiling 6. Also, diaphragm 3 is suspended from bottom 5 to a ring 14 which is supported from the bottom by a number of rods 15. The ring 14 has a groove into which the rim of ceiling 6 fits, while the ceiling itself is permanently fixed to housing part 4 by spacers 16. Said groove and rim form the separable joint which allows the cartridge to be removed. In this example the cartridge comprises the anode 1, bottom 5, diaphragm 3, ring 14 and rods 15.

Alternatively, the anode cone may be inverted, i.e., its apex disposed upwardly, and having a hole at the apex to allow the chlorine gas to escape therethrough.

FIG. 3 is distinguished from FIG. 1 mainly by diaphragm 3 and cathode 2 being formed by truncated hollow cones, affording somewhat shorter paths of current between the anode and cathode. As in FIG. 2, the ceiling 6 is fixed to the housing 4, the separable seal being directly between the rim of the ceiling and the top of the diaphragm, made possible by their conical shapes. This figure also shows how a brace ring 17 of U-section can be used to tighten the bottom 5 to the rim of the housing part 4. Naturally, conical shaped cathode and diaphragm could be shaped to have their wider ends downwards. The attendant disadvantage of longer lines of current path may be outweighed by lessening of the hydrogen bubbling along the diaphragm surface, and also by easier molding of the plastic parts.

In FIG. 4 the anode and cathode chambers have exchanged positions, the anode chamber 24 being outside the cathode chamber 25 but still concentric therewith. The removable cartridge consists of a plane ring 18 carrying a perforated cylindrical sleeve 19 which supports the diaphragm 3. The top of the sleeve 19 seals against the rim of ceiling 6. At the bottom of the cell, the ring 18 seals against the outer housing part 4 and an inner housing part 22. The anode 1, which can be suported by the sleeve 19, is electrically connected through the bottom of the cartridge by the lead 23. An advantage is that the cathode chamber 25 will have somewhat smaller volume, so that, during long periods of standstill, there is less volume of alkali that can diffuse into the anode chamber 24.

It should be noted that, while the position of the anode 1 in FIGS. 1 to 4 should be above the top rim of the diaphragm 3, there is little disadvantage of having a small portion of the anode extending below the top level of the diaphragm, even if that portion would be exposed to alkali-infected brine. Thus, for instance, it is not necessary to insulate the conductor 23 in FIG. 4. Furthermore, if this conductor is made of uncoated titanium, it would cover itself with a protective layer of oxide and take little part in the electrolytic process.

In the examples shown in FIGS. 1 to 4, where the anode 1 and the cathode 2 as well as the diaphragm 3 are made of sheetlike material, these parts are circular in plan view and concentric.

FIG. 5 and 6 show, in two sections as indicated, a rectilinear or planar embodiment of the cell. The cell vessel consists of two flat sidewalls 30, a bottom 31, end walls 32 and 34 and a top which is inclined up towards the centre, debouching into tube 9. Two flat partitions 33 are provided and extended between end-walls 32 and 34 parallel to the sidewalls and their inter-space debouches into the inner tube 8.

The partitions 33 have grooves on their lower surfaces to receive respective upper edges of perforated sheets 35. The bottom 31 is provided with a pair of grooved flanges 36 in which the lower edges of the sheets 35 are received. Each sheet 35 carries a flat diaphragm segment 3 on the inner side, that is, the side facing the other sheet, and a pair of anode sections 1 in the form of straight rods or tubes disposed on the outer sides of and spaced from the sheets 35. The cathode 2 in the form of a flat plate is disposed between the diaphragms 3 and is carried by the bottom 31. In this arrangement the removable cartridge comprises the end wall 34 and perforated sheets 35, the diaphragm segments 3 and anode sections 1 being removed with the sheets 35.

Figure 7:
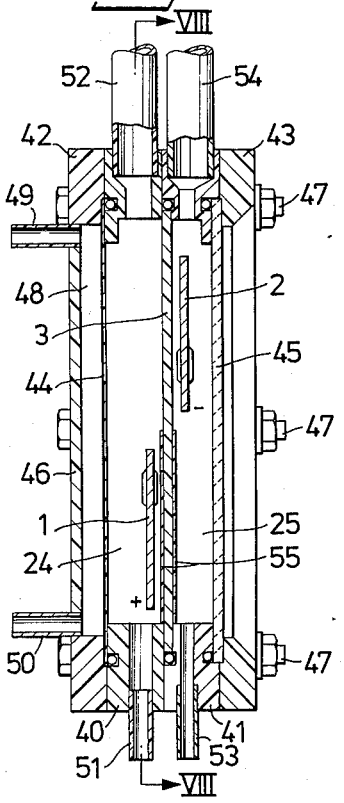
FIGS. 7 and 8 show another alternative design having the anode and cathode chambers side by side.
Figure 8:
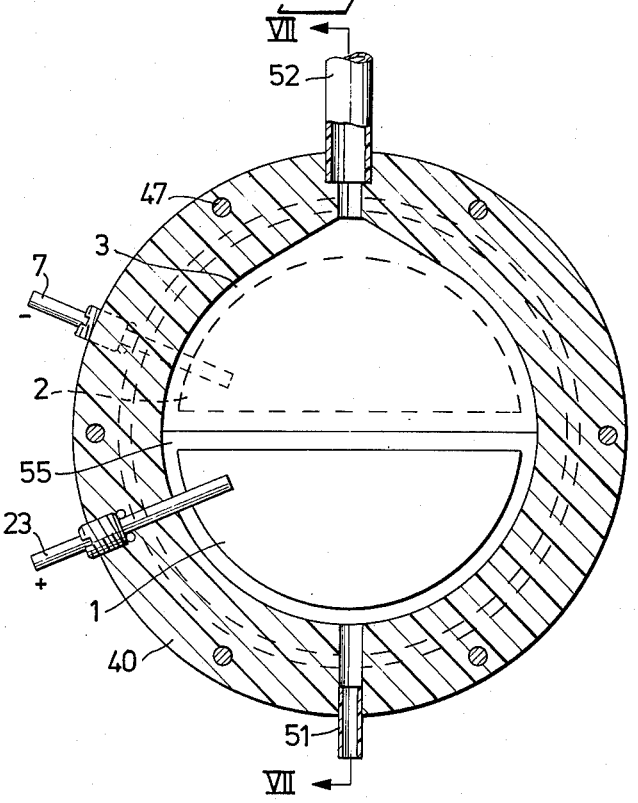

FIGS. 7 and 8 show a cell which differs from the cells shown in FIGS. 1 to 6 in some respects. As in the cell shown in FIGS. 5 and 6, the anode 1 and cathode 2 are flat and parallel and spaced both vertically and horizontally but the anode is disposed at the lower level in this case. The circular housing of the cell in FIGS. 7 and 8 is comprised of two inner rings 40 and 41, two outer rings 42 and 43 and three parallel circular plates 44, 45 and 46. These rings and plates as well as the diaphragm 3 are vertical and concentric, and a series of bolts 47 hold the rings together with the two inner rings 40 and 41 clamping between them the flat diaphragm 3, the inner ring 40 and the outer ring 42 clamping between them the sheet metal plate 44 and the inner ring 41 and the outer ring 43 clamping between them the plate 45 which is made of glass or another suitable transparent material permitting visual inspection of the cathode chamber 25 in operation of the cell. The sheet metal plate 44 and the third plate 46 define between them a cooling chamber 48 through which a coolant can be circulated by way of inlet and outlet tubes 49 and 50 to limit the temperature rise in the anode chamber 24.

A brine inlet tube 51 opens into the lowermost portion of the anode chamber 24, and a chlorine gas outlet tube 52 is in open communication with the uppermost portion of the anode chamber. Similarly, a caustic liquid outlet tube 53 and a hydrogen gas outlet tube 54 are in open communication with respectively the lowermost and the uppermost portion of the cathode chamber 25.

The anode 1 and cathode 2, which are semicircular and made of expanded sheet metal, are supported in the anode and cathode chambers by rods extending radially through the inner housing rings 40 and 41 and constituting the electrical connections 23 and 7.

The diaphragm 3 in this case is constituted by the upper half of a circular porous plate the lower half of which has been made impervious both to the liquid in the anode and cathode chambers and to the electricity-carrying ions by the application to both sides thereof of a thin layer of polyvinyl chloride cement. Thus, the impervious lower half of the porous diaphragm plate is effective in minimizing the amount of the caustic liquid formed in the cathode chamber reaching the anode chamber and interfering with the operation of the anode. The caustic liquid is collected in the pocket defined between the lower halves of the diaphragm plate and the transparent plate 45 and is carried away from this pocket through the outlet tube 53.

A common feature in all examples illustrated is a vertical separation or spacing of anode and cathode, accompanying the lateral separation or spacing of them with the anode either at the higher or at the lower level. It should be noted, however, that there may be no disadvantage in extending the cathode vertically past the anode, but such extended part of the cathode would be electrolytically rather inactive and useless. One advantage of the lateral spacing is that, should a crack develop in the diaphragm, the likelihood of hydrogen passing through the crack and entering the anode chamber is minimized. Experience has shown that, in fact, the cells of this invention can tolerate small cracks or perforations of the diaphragm with only slight drop in efficiency.

Where in this specification and in the claims reference is made to the anode, cathode and diaphragm, that reference should be understood to mean only those portions of the anode, cathode or diaphragm which for practical purposes can be considered active in the electrolytic process. The just-mentioned parts may have extensions, for instance for mounting purposes, which do not appreciably take part in the operation of the cell and which, accordingly, should be disregarded when reference is made to these parts. Moreover, where reference is made to the diaphragm being vertical or substantially vertical, that reference should be understood to mean that the diaphragm deviates from exact vertical orientation by less than 45°. The preferred maximum deviation being less than about 15°, the deviation is about 10° or less in the cells shown in the drawings.

What is claimed is:

1. An electrolytic cell for oxidizing chloride ions to generate chlorine gas, comprising a housing having an anode chamber and a cathode chamber disposed side by side, a substantially vertical semi-permeable non-conductive diaphragm through which the anode and cathode chambers communicate with each other, an anode and a cathode disposed respectively in the anode and the cathode chamber, said anode being vertically spaced from the diaphragm and horizontally spaced from the cathode, a brine inlet and a chlorine gas outlet in communication with the anode chamber, and an outlet in communication with the cathode chamber for discharging cathodic electrolysis products.

2. An electrolytic cell as claimed in claim 1 in which the anode is disposed above the diaphragm.

3. An electrolytic cell as claimed in claim 2 in which the anode comprises an essentially horizontally disposed disc and the cathode comprises an annular collar of sheet material disposed below the anode and opposite to the diaphragm in the horizontal direction.

4. An electrolytic cell as claimed in claim 3 in which the anode disc, the diaphragm and the cathode are circular in plan view and concentric.

5. An electrolytic cell as claimed in claim 4 in which the anode is dish shaped and disposed with its convex side downwardly, the periphery of the anode and a portion of the housing defining an annular passage communicating with the chlorine gas outlet.

6. An electrolytic cell as claimed in claim 4 in which the anode is perforated.

7. An electrolytic cell as claimed in claim 4 in which the cathode comprises a truncated hollow cone.

8. An electrolytic cell as claimed in claim 1 in which the anode is annular and in which the cathode and the diaphragm each comprise an annular cylinder of sheet material and are concentric with each other with the diaphragm surrounding the cathode.

9. An electrolytic cell as claimed in claim 1 in which the anode is disposed below the diaphragm.

10. An electrolytic cell as claimed in claim 11 in which the anode, the cathode and the diaphragm comprise parallel flat plates.

11. An electrolytic cell for oxidizing chloride ions to generate chlorine gas, comprising a housing having an anode chamber and a cathode chamber disposed side by side, said anode chamber comprising two compartments each having an anode section, a brine inlet and a chlorine gas outlet in communication with the anode chamber, a substantially vertical semi-permeable diaphragm through which the anode and cathode chambers communicate with each other, said anode chamber compartments being disposed on opposite sides of the cathode chamber and communicating therewith through respective diaphragm segments, an anode and cathode disposed respectively in the anode and cathode chambers, said anode being vertically spaced from the diaphragm and horizontally spaced from the cathode, and an outlet in communication with the cathode chamber for discharging cathodic electrolysis products.

12. An electrolytic cell as claimed in claim 11 in which the cathode comprises a flat plate, each diaphragm segment comprises a flat plate parallel to the cathode, and each anode section is elongated and extends parallel to the cathode.

13. An electrolytic cell for oxidizing chloride ions to generate chlorine gas, comprising a housng having an anode chamber and a cathode chamber disposed side by side, a substantially vertical semi-permeable diaphragm through which the anode and cathode chambers communicate with each other, an anode and a cathode disposed respectively in the anode and cathode chamber, said anode being vertically disposed below the diaphragm and horizontally spaced from the cathode, said cathode chamber extending below the lowermost portion of the diaphragm and in which the lowermost portion of the cathode chamber opens into an outlet for discharging caustic electrolytic products from the cathode chamber, and a brine inlet and a chlorine gas outlet in communication with the anode chamber.

* * * * *